US005519417A

United States Patent [19]

Stephany et al.

[11] Patent Number: 5,519,417

[45] Date of Patent: May 21, 1996

[54] POWER CONTROL SYSTEM FOR A PRINTER

[75] Inventors: Joseph F. Stephany, Williamson; Juan J. Becerra, Webster; Peter J. John, Rochester; Gary A. Kneezel, Webster; Richard V. LaDonna, Fairport; Thomas E. Watrobski, Penfield; Joseph J. Wysocki, Webster, all of N.Y.

[73] Assignee: Xerox Corporation, Stamford, Conn.

[21] Appl. No.: 220,720

[22] Filed: Mar. 31, 1994

[51] Int. Cl.[6] ..... B41J 2/07

[52] U.S. Cl. ..... 347/14; 347/57

[58] Field of Search ..... 347/57, 14, 10, 347/9, 15, 17, 194; 307/117

[56] References Cited

U.S. PATENT DOCUMENTS

| | | | |
|---|---|---|---|
| 5,017,948 | 5/1991 | Koizumi et al. | 347/14 |
| 5,057,855 | 10/1991 | Damouth | 347/57 |
| 5,083,137 | 1/1992 | Badyal et al. | 347/14 |
| 5,223,853 | 6/1993 | Wysocki et al. | 347/14 |
| 5,300,968 | 4/1994 | Hawkins | 347/12 |

FOREIGN PATENT DOCUMENTS

| | | | |
|---|---|---|---|
| 4-310747 | 11/1992 | Japan | 347/9 |

*Primary Examiner*—Benjamin R. Fuller
*Assistant Examiner*—Craig A. Hallacher
*Attorney, Agent, or Firm*—Oliff & Berridge

[57] ABSTRACT

A control system for a printer having at least one heating element for producing spots applies one of a plurality of voltage levels to at least one heating element disposed on a printhead. A voltage supply supplies a voltage to a first one of a plurality of switches connected in series with a last one of the switches being connected to the at least one heating element. At least one of the switches defines a first path and a second path having different voltage drops. A controller coupled to the plurality of switches selectively actuates the switches to apply one of a plurality of predetermined voltages to the at least one heating element.

24 Claims, 4 Drawing Sheets

POWER CONTROL SYSTEM FOR A PRINTER

BACKGROUND OF THE INVENTION

1. Field of the Invention

This invention relates to a high-speed, high-efficiency, high-precision voltage control system for an ink jet printer.

2. Description of the Prior Art

In thermal ink jet printing, droplets of ink are selectively emitted from a plurality of drop ejectors in a printhead, in accordance with digital instructions, to create a desired image on a surface. The printhead typically comprises a linear array of ejectors for conveying the ink to a sheet. The printhead may move back and forth relative to a surface, for example to print characters, or the linear array may extend across the entire width of a sheet (e.g. a sheet of plain paper) moving relative to the printhead. The ejectors typically comprise capillary channels, or other ink passageways, forming nozzles which are connected to one or more common ink supply manifolds. Ink from the manifold is retained within each channel until, in response to an appropriate digital signal, the ink in the channel is rapidly heated and vaporized by a heating element disposed within the channel. This rapid vaporization of the ink creates a bubble which causes a quantity of ink to be ejected through the nozzle to the sheet.

U.S. Pat. No. 5,223,853 to Wysocki et al., entitled "Electronic Spot Size Control in a Thermal Ink Jet Printer," which is assigned to the assignee of the present application, is herein incorporated by reference. Wysocki et al. discloses a system by which ink jet droplets of a consistent size are ejected from a thermal ink jet printhead, regardless of the original temperature of the liquid ink in the printhead. As described in detail in Wysocki et al., one of the most crucial parameters for image quality in an ink jet printer is the spot size of individual droplets of ink emitted from the printhead, and in turn an important parameter for determining the spot size of individual droplets is the temperature of the liquid ink immediately before ejection. The system of Wysocki et al. operates on the principle of first measuring the temperature of the liquid ink in the printhead and then, in response to this measured temperature, providing to the printhead an optimal combination of power (typically voltage) and pulse duration to a heating element which is used to vaporize the liquid ink and cause it to be ejected from the printhead. From the standpoints of preventing overheating of the printhead chip, avoiding kogation of ink within the printhead, and other practical concerns, a selected pulse duration must be coupled with an appropriate power level, and vice-versa. For each measured temperature there is provided in this system a best combination of amplitude and pulse width, as opposed to a system which merely increases or decreases one input or the other.

In a typical configuration of a thermal ink jet printhead, a linear array of ejectors, in one embodiment, has 128 ejectors spaced 300 to the inch, which is caused to move across a sheet on which an image is to be printed. The ejectors are activated, as necessary according to the desired image, in groups of four ejectors at a time across the array, while the array itself may move across the sheet. Thus, in some situations a set of ejectors may be activated every 4 microseconds. In order to realize a spot size control system such as that disclosed in Wysocki et al., a system for providing the best combination of power and pulse duration must be able to react to very quick changes in temperature of the liquid ink in the printhead, particularly as the action of the printhead itself is the main contributor to changes in temperature of the liquid ink. In a realistic practical application, the temperature of liquid ink in the printhead could change significantly within 200 microseconds. Further, because the necessary combination of voltage and pulse duration for one temperature may be completely different from that for the "neighboring" temperature, a control system may have to change its voltage very abruptly, for example, from 38 volts to 41 volts, in a stepwise manner with minimal time for transition.

In addition to the problems of time lag associated with traditional analog voltage-supply devices such as that used in Wysocki et al., which can typically change voltage at no more that 1 volt per millisecond, there is the problem that such power supply devices operate on the principle of "throwing voltage away" when a lesser voltage is suddenly needed. When voltage is reduced by an analog circuit, the power which is not output in the form of a voltage is at least temporarily dissipated as heat. When such heat is generated in components such as partially turned-on power transistors, the component performance can degrade, so that expensive cooling means are required to effectively remove the heat. For these reasons, a power supply system is needed for ink jet printers which is of very quick response, and which provides accurate voltage levels as needed without generation of excess heat in components whose performance or reliability is very dependent upon temperature.

In the prior art, U.S. Pat. No. 5,017,948 discloses a control system for an ink-jet printer in which the voltage applied to the heating elements is adjusted as a function of the number of heating elements actuated at a given time.

U.S. Pat. No. 5,083,137 discloses a control system for an ink-jet printer in which the voltage applied to the heating elements is compared to a reference voltage through a comparator, the output of the comparator being applied to the gate of a PMOS driver driving the heating elements.

SUMMARY OF THE INVENTION

Accordingly, it is an object of this invention to provide a control system for varying the voltage applied to heater elements of a printer.

It is also an object of this invention to provide such a control system that can vary the voltage applied to the heater element at a high operational frequency.

It is also an object of this invention to provide such a control system that varies the voltage applied to the heater elements of a printer based on temperature of a printhead to maintain a constant spot size.

It is also an object of this invention to provide such a control system that does not require transistor control of the voltage applied to the heater elements, which generates excessive heat in components whose performance or reliability is thereby degraded unless external cooling means are provided.

It is also an object of this invention to provide such a control system that separately varies the voltage applied to heater elements contained on each of a plurality of printheads within a printer.

It is also an object of this invention to provide such a control system that does not require a digital-to-analog converter or power transistors to control the amplitude of the pulse applied to the heating element.

To achieve the above and other objects, this invention includes a control system for a printer having at least one heating element for producing spots. A voltage is supplied to a plurality of switches connected in series. At least one of the switches defines a first path or a second path having different voltage drops. A controller coupled to the switches selectively actuates the switches to apply one of a plurality of predetermined voltages to at least one heating element connected to a last of the switches.

BRIEF DESCRIPTION OF THE DRAWINGS

These and other aspects and advantages will become apparent from the following detailed description of preferred embodiments taken in conjunction with the accompanying drawings, in which like reference numerals represent like elements.

DETAILED DESCRIPTION OF PREFERRED EMBODIMENTS

Figure 1:
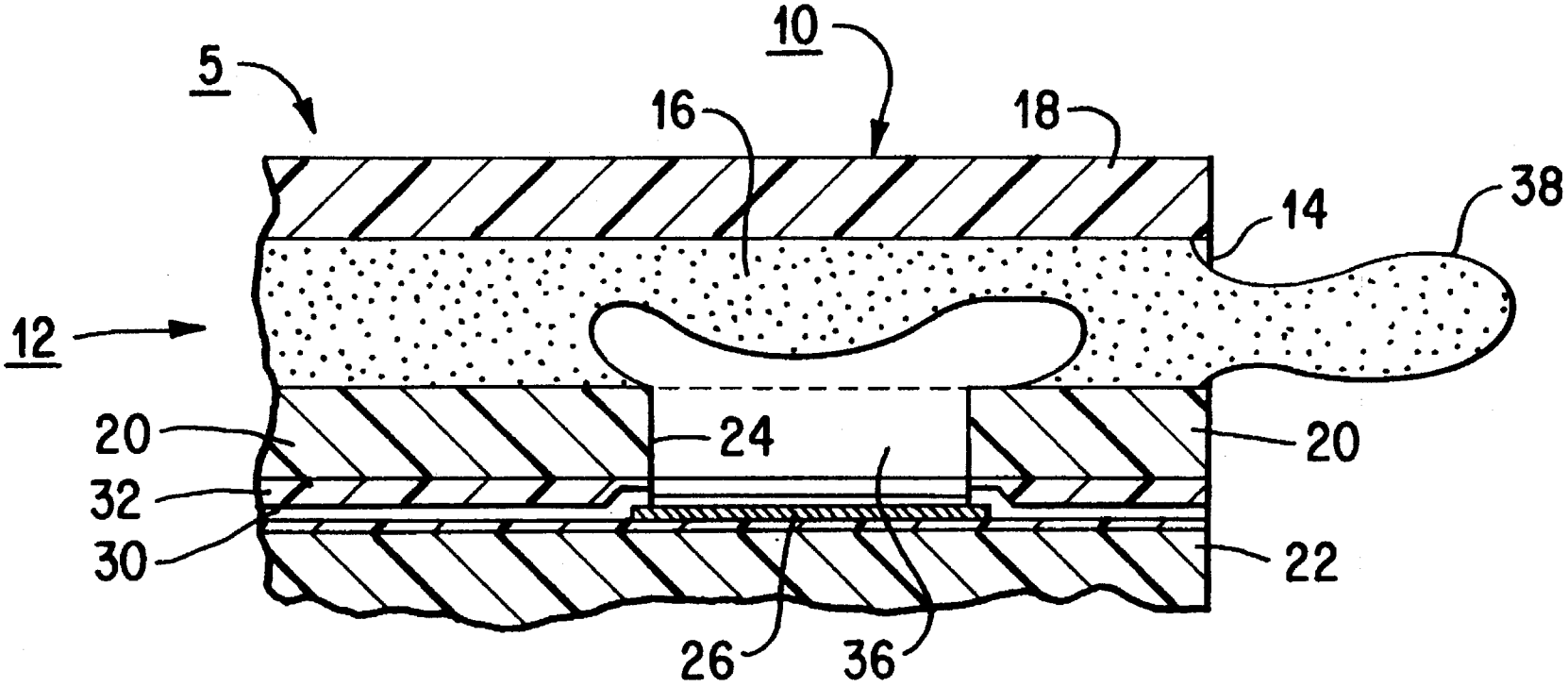
FIG. 1 is a sectional elevational view of a nozzle of an ink jet printhead.

FIG. 1 is a fragmentary sectional elevational view of a single drop ejector 10 of an ink jet printhead, one of a large plurality of such ejectors which would be found in one version of an ink jet printhead. Typically, such ejectors are sized and arranged in linear arrays of 300 or more ejectors per inch. As will be used in the detailed description, a silicon member having a plurality of channels for drop ejectors defined therein is known as a "die module" or "chip," and is here indicated generally as 5. In currently popular designs, a typical chip such as 5 includes as many as 128 ejectors 10, spaced 300 or more to the inch. In designs with multiple chips, each chip may include its own ink supply manifold, or multiple chips may share a single common ink supply manifold.

Each ejector generally indicated as 10, includes a capillary channel 12 which terminates in an orifice 14. The channel 12 regularly holds a quantity of ink 16 which is maintained within the capillary channel 12 until such time as a droplet of ink is to be ejected. Each of a plurality of capillary channels 12 are maintained with a supply of ink from an ink supply manifold (not shown). The channel 12 is typically defined by an abutment of several layers. In the ejector shown, the main portion of channel 12 is defined by a groove anisotropically etched in an upper substrate 18, which is made of a crystalline silicon. The upper substrate 18 abuts a thick-film layer 20, which in turn abuts a lower silicon substrate 22.

Sandwiched between thick film layer 20 and lower substrate 22 are electrical elements which cause the ejection of a droplet of ink from the capillary channel 12. Within a recess 24 formed by an opening in the thick film layer 20 is a heating element 26. The heating element 26 is typically protected by a protective layer made of, for example, a tantalum layer having a thickness of about 0.5 microns. The heating element 26 is electrically connected to an addressing electrode 30. Each of the large number of ejectors 10 in a printhead will have its own heating element 26 and individual addressing electrode 30, to be controlled selectively by control circuitry, as will be explained in detail below. The addressing electrode 30 is typically protected by a passivation layer 32.

When an electrical signal is applied to the addressing electrode 30, energizing the heating element 26, the liquid ink immediately adjacent the element 26 is rapidly heated to the point of vaporization, creating a bubble 36 of vaporized ink. The force of the expanding bubble 36 causes a droplet 38 of ink to be emitted from the orifice 14 onto the surface of a sheet. The "sheet" is the surface on which the mark or spot is to be made by the droplet, and may be, for example, a sheet of paper or a transparency.

In imparting energy to liquid ink in the capillary channel 12 to cause ejection thereof, the electrical energy converted to thermal energy by heating element 26 may be controlled by either or both of two variables: the voltage applied to the heating element 26, and the time duration of the voltage pulse to cause the ejection of droplet 38. The minimum voltage applied to heating element 26 to cause the ejection of droplet 38 is known as the "threshold voltage." The voltage applied to heating element 26 must be in excess of this threshold voltage; however, if the applied voltage to heating element 26 is excessively greater than the threshold voltage, not only will there be a waste of energy in operating the printhead, but the excess energy will ultimately cause the printhead to overheat, thus increasing the temperature of the liquid ink in the printhead, very likely affecting the spot size. Further, excessive voltage will significantly decrease the working life of the printhead, either by gradually baking ink residue onto the heating elements, or by catastrophically causing an open circuit in the heating element. Similar temperature and wear problems may result from excessive duration of the voltage pulses applied to the heating element 26.

Figure 2:
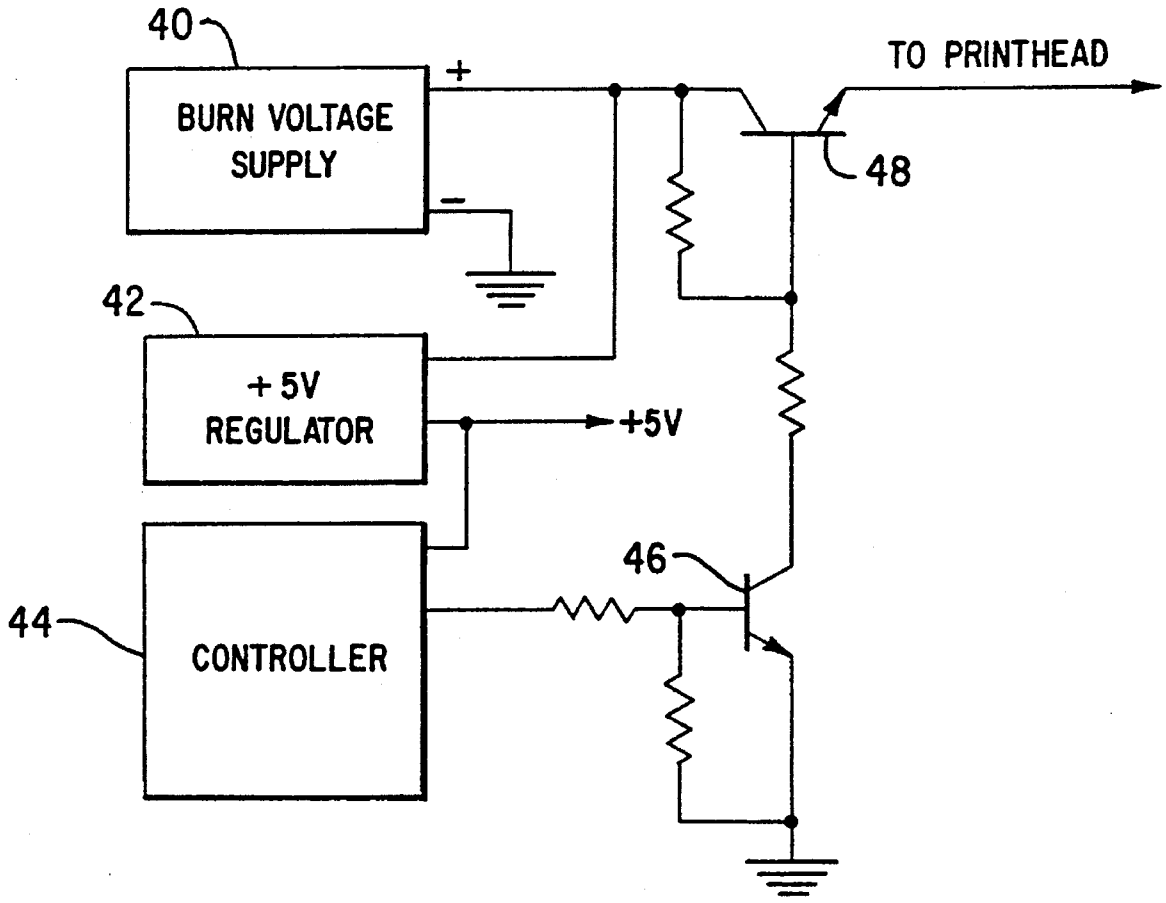
FIG. 2 RELATED ART
FIG. 2 is a schematic diagram illustrating a control system for supplying a constant voltage to a printhead.

FIG. 2 is a schematic diagram of a conventional control system for supplying a voltage to heater elements of a printhead. This conventional system can only supply a constant, non-varying voltage to the printhead. In this conventional control system, burn voltage supply 40 supplies a constant voltage, typically of about 38 volts to regulator 42 and to transistor 48. Regulator 42 outputs a constant 5 volt signal, which is input to controller 44, as well as to various other circuitry (not shown). Transistor 48 is typically a very small low power transistor since it dissipates little power. Controller 44 controls the voltage applied to the printhead by selectively applying signals to the gate of transistor 46, turning on transistors 46 and 48 and thus applying the voltage from burn voltage supply 40 to the printhead with a small voltage drop across transistor 48. This control system is incapable of varying the voltage supplied to the printhead from burn voltage supply 40.

Figure 3:
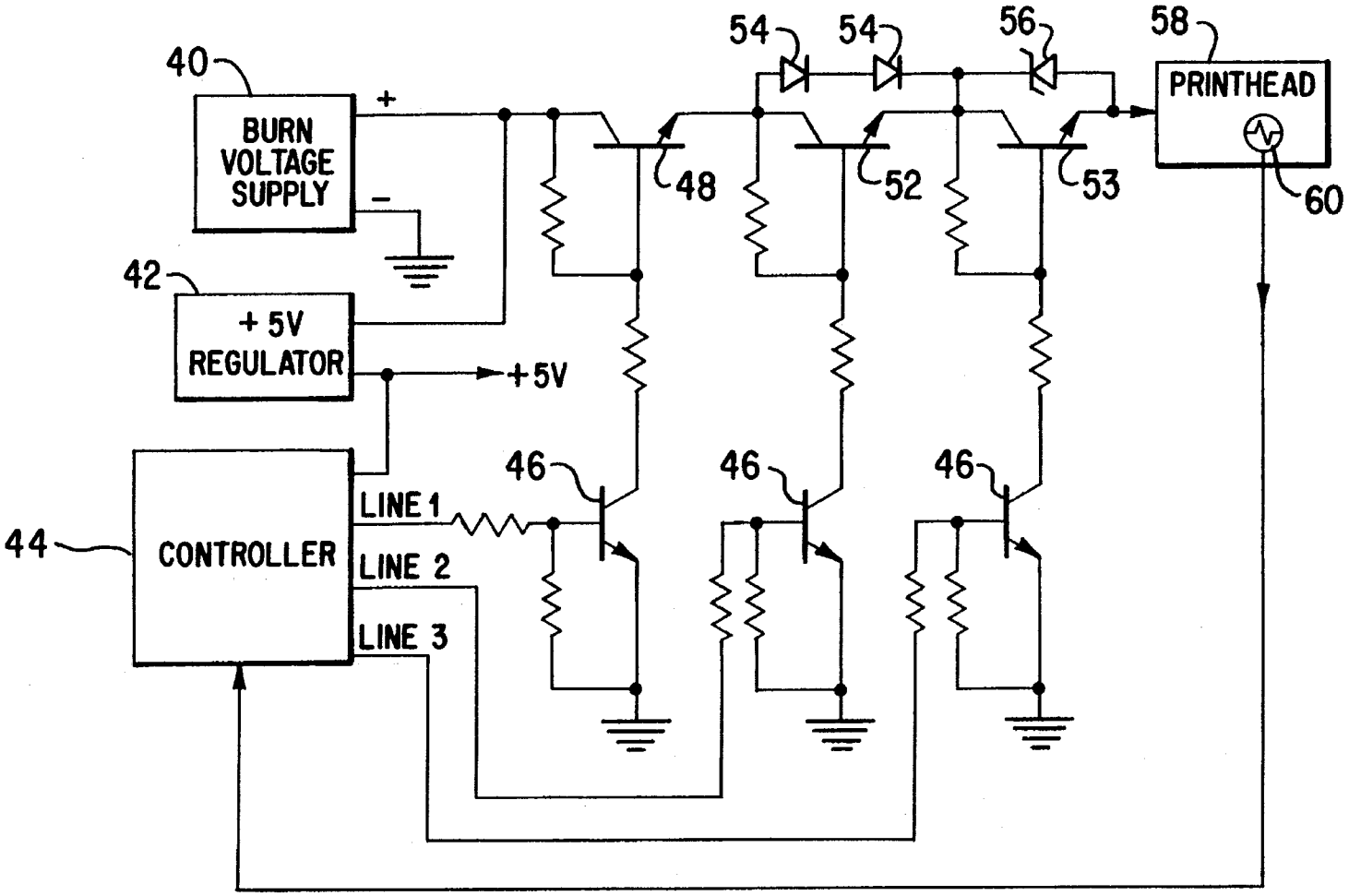
FIG. 3 is a schematic diagram showing the control system of the present invention.

FIG. 3 is a schematic diagram of the control system according to one embodiment of the present invention. Elements of FIG. 3 that are identical to those shown in FIG. 2 function in the same manner. However, the present invention as shown in FIG. 3 is capable of applying one of a plurality of predetermined voltages to at least one heater element 26 contained on printhead 58. Three separate control lines extend from controller 44 and connect to the gates of transistors 46. Line 1 extending from controller 44 switches on and off transistor 48 to control the application of a voltage to printhead 58. Lines 2 and 3 act to switch on or off transistors 52 and 53 which are in series with transistor 48. Each of the transistors 48, 52 and 53 have a voltage drop of approximately 0.6 volts. Thus, when transistors 48, 52 and 53 are all on, a maximum voltage will be applied to printhead 58 equal to the voltage output from burn voltage supply 40 minus 1.8 volts, 0.6 volts for each of the transistors 48, 52 and 53 used in this embodiment. However, more transistors could be added in series with those shown to provide more voltage steps, in which case a burn voltage supply 40 outputting a higher voltage may be required.

Transistors 52 and 53 may be selectively turned off or on by controller 44 through lines 2 and 3 to apply various stepped voltages to printhead 58. For example, controller 44 could turn off the middle transistor 46 in FIG. 3, turning off transistor 52, while leaving on transistors 48 and 53. In this case, the voltage applied to printhead 58 would be equal to the voltage output from burn voltage supply 40 minus 0.6 volts dropped across transistor 48 minus 1.2 volts dropped across the two diodes 54 minus 0.6 volts dropped across transistor 53. Thus, in this situation, the voltage applied to printhead 58 would be equal to the voltage output from burn voltage supply 40 minus 2.4 volts. Alternatively, transistor 52 could be turned on while transistor 53 is turned off. This would produce a voltage applied to printhead equal to the voltage output from burn voltage supply 40 minus 0.6 volts dropped across transistor 48 minus 0.6 volts dropped across transistor 52 minus the voltage dropped across zener diode 56.

If a different voltage step was needed, diodes having a different voltage drop or a different number of diodes could be used to bypass transistors 52 or 53. Transistor 53 is shown in FIG. 3 with a zener diode 56 bypassing transistor 53. The zener diode is used to provide a greater voltage drop than diodes 54 provide, and may have a voltage drop of approximately 3.0 volts. Both transistors 52 and 53 thus define two paths depending upon whether transistors 52 and 53 are turned on or off. The first path occurs when both of the transistors 52 or 53 are turned on, and this first path flows through transistors 52 and 53. The second path occurs when either of the transistors 52 and 53 is turned off, and this second path flows through diodes 54 or zener diode 56, respectively.

Each of the transistors 52 and 53, diodes 54 or zener diode 56 and an associated transistor 46 form a stage which allows one of two predetermined voltage drops to be applied to the signal input to printhead 58. The circuit of FIG. 3 shows two such stages but the invention may be modified so that any number of additional stages may be placed in series with the present stages to generate additional voltage steps. With the two stages shown in FIG. 3, there would be four selectable voltage steps. Additionally, the number of diodes bypassing any stage could be varied. For example, if transistor 52 was bypassed with three diodes 54, turning on or off transistor 52 would vary the voltage applied to printhead 58 by 1.2 volts. If the second stage transistor 53 was bypassed with 5 diodes 54, turning on or off the second stage transistor 53 would vary the voltage applied to printhead 58 by 2.4 volts. It would then be possible to generate four voltage steps of 0 volts, 1.2 volts, 2.4 volts, and 3.6 volts, by using various combinations of switching on and off transistors 52 and 53. By modifying FIG. 3 to add more stages, additional numbers of voltage steps would be available. For example, with three stages, eight steps could be made available. Each stage added would thus double the number of voltage steps available to printhead 58.

The circuit shown in FIG. 3 has the advantage that power loss occurring due to varying the voltage drop in the selected components does not occur primarily in the transistors but instead occurs in the external diodes 54 or 56, which can dissipate more heat at lower cost than if the heat was dissipated in a power transistor. This is because diode performance and reliability are less affected by high temperature operation, so that means for removing heat from the power dissipating diodes are not as expensive as would be the case if power transistors were used. This control system also eliminates the need for a digital to analog converter which may be needed in the case of continuous voltage control as shown in U.S. Pat. No. 5,223,853.

Thermistor 60, disposed on printhead 58, senses a temperature of printhead 58 and outputs a signal relative to the sensed temperature. This signal is then fed to controller 44, which selectively actuates transistors 52 and 53 to apply varying voltages to the heater elements 26 contained on printhead 58. By sensing the temperature on printhead 58, the controller controls transistors 52 and 53 to apply a voltage having a larger amplitude to printhead 58 coupled with a smaller pulse width (similar to the algorithm described in U.S. Pat. No. 5,223,853) as the temperature of printhead 58 rises in order to maintain a constant spot size of spots produced by heater elements 26. The system also reduces dropout that may occur when air is ingested into ejectors 10.

In some printer applications, more than one printhead (also referred to as dies, chips or cartridges) is used in a single printer. Such applications may include color printers, high speed black printers or plotters. In such applications, it is important for print quality that the spot sizes of the printheads be matched. Additionally, individual printheads may have different nominal drop sizes, may be at different temperatures or may have different printing threshold voltages. Thus, the present invention, as explained below in reference to FIG. 4, allows independently setting the voltages applied to each of a plurality of printheads contained in a printer.

Figure 4:
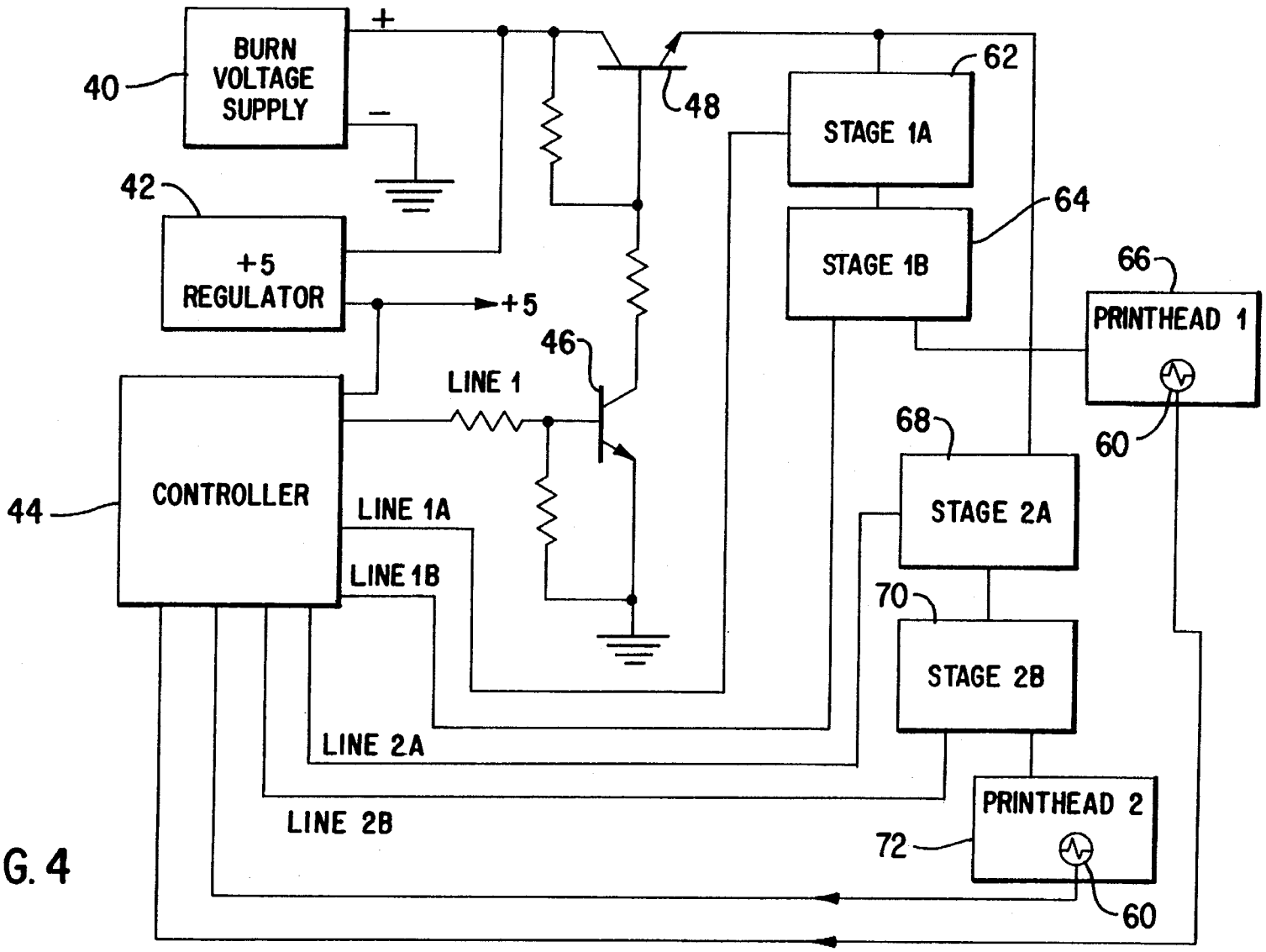
FIG. 4 is a schematic diagram showing a multiple printhead embodiment of the control system of the present invention.

FIG. 4 is a schematic diagram showing a multiple printhead embodiment of the present invention. Elements of FIG. 4 that are identical to those shown in FIG. 3 function in the same manner. However, the present invention, as shown in FIG. 4, separately applies one of a plurality of predetermined voltages to at least one heater element 26 contained on each of a plurality of printheads contained within a printer.

Line 1 extending from controller 44 switches on and off transistor 48 to control the application of a voltage to printheads 66 and 72. Each of the stages 62, 64, 68 and 70 contain appropriate transistors and diodes allowing predetermined voltage drops to be applied to signals sent to heater elements 26 contained on printheads 66 and 72, as explained above in reference to FIG. 3. Lines 1A, 1B, 2A and 2B act to apply one of two predetermined voltage drops in Stage 1A 62, Stage 18 64, Stage 2A 68 and Stage 2B 70, respectively, to the signals input to printheads 66 and 72. Thus, FIG. 4 allows different voltage drops to be applied to multiple printheads contained on a printer.

As detailed above, the present invention allows application of various stepped voltages to be selectively applied in a rapidly changeable fashion to heater elements 26 contained on printhead 58 using simple circuitry where power dissipation occurs in external diodes eliminating the need for large heat sinks while controlling spot size as the temperature of the printhead changes. Additionally, the control system of the present invention can be used to adjust for printheads having different printing threshold voltage levels. Thus a greater latitude in printhead manufacturing tolerances is acceptable, which increases printhead yield, thereby reducing printhead cost.

While the present invention has been described with respect to the thermal ink jet printhead geometry sometimes called a sideshooter, as shown in FIG. 1, the invention is also applicable to other thermal ink jet printhead geometries, such as a roofshooter.

While this invention has been described in conjunction with the specific embodiments thereof, it is evident that many alternatives, modifications and variations will be apparent to those skilled in the art. For example, voltage drop devices other than the diodes shown in FIG. 3, could be used or a temperature sensing device other than thermistor 60 could be used to sense the temperature of the printhead. Accordingly, the preferred embodiments of this invention, as set forth herein, are intended to be illustrative and not limiting. Various changes may be made without departing from the spirit and scope of the invention as defined in the following claims.

What is claimed is:

1. A control system for a printer having at least one heating element for producing spots, said control system comprising:

a voltage supply;

a plurality of switches connected in series, a first of said plurality of switches connected to said voltage supply and a last of said switches connected to said at least one heating element, at least one of said plurality of switches defining a first path and a second path between said voltage supply and said at least one heating element, said first path and said second path having different voltage drops; and a controller coupled to said plurality of switches, said controller selectively actuating said plurality of switches to determine one of said first path and said second path and thereby apply one of a plurality of predetermined voltages to said at least one heating element.

2. The control system of claim 1, further comprising voltage dropping means located along said second path for reducing a voltage applied to a first end of said second path by a predetermined amount.

3. The control system of claim 2, wherein said voltage dropping means comprises at least one diode.

4. The control system of claim 1, wherein each of said plurality of switches comprises a transistor.

5. The control system of claim 1, wherein said at least one of said plurality of switches defines said first path when actuated to a closed position by said controller and defines said second path when actuated to an open position by said controller.

6. The control system of claim 1, wherein said printer is a thermal ink jet printer.

7. The control system of claim 1, further comprising sensing means for sensing a temperature of a printhead on which said at least one heating element is contained.

8. The control system of claim 7, wherein said sensing means comprises a thermistor.

9. The control system of claim 7, wherein said sensing means is connected to said controller and said controller selectively actuates said at least one of said plurality of switches in response to the temperature sensed by said sensing means.

10. A control system for a printer having at least one heating element for producing spots said control system comprising:

a voltage supply;

a plurality of switches connected in series, a first of said plurality of switches connected to said voltage supply, at least one of said plurality of switches defining a first path and a second path to said at least one heating element, the first path including said at least one switch and the second path being parallel to and bypassing said switch, the first path and the second path having different voltage drops, a last of said switches connected to said at least one heating element; and a controller coupled to said plurality of switches, said controller selectively switching the at least one of said plurality of switches to select one of said first path and said second path to apply one of a plurality of predetermined voltages defined by said voltage source and said paths to said at least one heating element.

11. The control system of claim 10, further comprising voltage dropping means located along said second path for reducing a voltage applied to a first end of said second path by a predetermined amount.

12. The control system of claim 11, wherein said voltage dropping means comprises at least one diode.

13. The control system of claim 10, wherein each of said plurality of switches comprises a transistor.

14. The control system of claim 10, wherein said printer is a thermal ink jet printer.

15. The control system of claim 10, further comprising sensing means for sensing a temperature of a printhead on which said at least one heating element is contained.

16. The control system of claim 15, wherein said sensing means comprises a thermistor.

17. The control system of claim 15, wherein said sensing means is connected to said controller and said controller selectively actuates said at least one of said plurality of switches in response to the temperature sensed by said sensing means.

18. A control system for a printer having at least one printhead, each of said at least one printhead having at least one heating element for producing spots, said control system comprising:

a voltage supply;

a switch connected to said voltage supply;

at least one respective stage connected between said switch and each of said at least one printhead, each of said at least one respective stage having a first path and a second path to said at least one heating element, the first path and the second path having different voltage drops; and a controller connected to said switch and said at least one respective stage, the controller selectively actuating said switch to apply a voltage from said voltage supply to said at least one respective stage and selectively enabling one of the first path and the second path of each of said at least one respective stage to apply the voltage decreased by a voltage drop of an enabled path of said at least one respective stage to said at least one heating element contained on said at least one printhead.

19. The control system of claim 18, further comprising voltage dropping means located along said second path for reducing a voltage applied to said at least one respective stage by a predetermined amount.

20. The control system of claim 19, wherein said voltage dropping means comprises at least one diode.

21. The control system of claim 18, wherein said printer is a thermal ink jet printer.

22. The control system of claim 18, further comprising sensing means for sensing a temperature of said at least one printhead on which said at least one heating element is contained.

23. The control system of claim 22, wherein said sensing means comprises a thermistor.

24. The control system of claim 22, wherein said sensing means is connected to said controller and said controller selectively enables said first path or said second path of said at least one of said respective stages in response to the temperature sensed by said sensing means.

* * * * *